US011339520B2

(12) United States Patent
Rios Acebal

(10) Patent No.: US 11,339,520 B2
(45) Date of Patent: May 24, 2022

(54) LAUNDRY TREATING APPLIANCE WITH A BELLOWS

(71) Applicant: WHIRLPOOL CORPORATION, Benton Harbor, MI (US)

(72) Inventor: Marcos Javier Rios Acebal, Monterrey (MX)

(73) Assignee: Whirlpool Corporation, Benton Harbor, MI (US)

( * ) Notice: Subject to any disclaimer, the term of this patent is extended or adjusted under 35 U.S.C. 154(b) by 199 days.

(21) Appl. No.: 16/586,819

(22) Filed: Sep. 27, 2019

(65) Prior Publication Data

US 2021/0095411 A1 Apr. 1, 2021

(51) Int. Cl.

| | |
|---|---|
| ***D06F 37/26*** | (2006.01) |
| ***D06F 25/00*** | (2006.01) |
| ***D06F 37/22*** | (2006.01) |
| ***D06F 58/02*** | (2006.01) |
| ***D06F 58/22*** | (2006.01) |
| ***D06F 58/20*** | (2006.01) |
| *A47L 15/00* | (2006.01) |

(52) U.S. Cl.

CPC ..... *D06F 37/266* (2013.01); *D06F 25/00* (2013.01); *D06F 37/22* (2013.01); *D06F 37/26* (2013.01); *D06F 58/02* (2013.01); *D06F 58/20* (2013.01); *D06F 58/22* (2013.01); *A47L 15/0097* (2013.01)

(58) Field of Classification Search

CPC ..... D06F 25/00; D06F 37/22; D06F 37/26; D06F 37/266; D06F 58/02; D06F 58/20; D06F 58/22

See application file for complete search history.

(56) References Cited

U.S. PATENT DOCUMENTS

| | | | | |
|---|---|---|---|---|
| 5,860,300 | A * | 1/1999 | Valent | D06F 37/266 68/24 |
| 7,571,626 | B2 | 8/2009 | Choi et al. | |
| 9,260,812 | B2 | 2/2016 | Moon et al. | |
| 9,732,459 | B2 | 8/2017 | Kim et al. | |
| 2004/0148978 | A1* | 8/2004 | Kim | D06F 37/267 68/23 A |

(Continued)

FOREIGN PATENT DOCUMENTS

| | | |
|---|---|---|
| CN | 109306597 A1 | 2/2019 |
| DE | 3202138 U1 | 12/1992 |

(Continued)

OTHER PUBLICATIONS

Machine translation of JP-2013085778-A to Imanari et al. (Year: 2013).*

(Continued)

*Primary Examiner* — Joseph L. Perrin
(74) *Attorney, Agent, or Firm* — McGarry Bair PC

(57) ABSTRACT

A laundry treating appliance comprising a chassis including a chassis opening, a tub with a tub opening, a drum defining a treating chamber, an annular bellows extending between the tub opening and the chassis opening having an inner peripheral surface, a closure to selectively open/close the chassis opening, and an air recirculating system including a recirculating conduit and deflection component that can crate a circumferential airflow about the annular bellows.

14 Claims, 9 Drawing Sheets

(56) References Cited

U.S. PATENT DOCUMENTS

| | | | | |
|---|---|---|---|---|
| 2005/0178170 | A1* | 8/2005 | Kim | D06F 25/00 68/24 |
| 2016/0305060 | A1 | 10/2016 | Kehl et al. | |
| 2017/0175320 | A1* | 6/2017 | Masters | D06F 29/005 |
| 2020/0216999 | A1* | 7/2020 | Xu | D06F 37/266 |
| 2020/0270793 | A1* | 8/2020 | Kim | D06F 37/266 |

FOREIGN PATENT DOCUMENTS

| | | | | |
|---|---|---|---|---|
| EP | 3181751 | A1 | | 6/2017 |
| EP | 2843098 | B1 | | 10/2017 |
| GB | 2287475 | A | | 9/1995 |
| JP | 2010246700 | A | * | 11/2010 |
| JP | 2013085778 | A | * | 5/2013 |
| JP | 2018015252 | A | * | 2/2018 |
| KR | 20030061190 | A | | 7/2003 |
| KR | 100584265 | B1 | | 5/2006 |
| KR | 20090099809 | A1 | | 9/2009 |
| KR | 101008618 | B1 | | 1/2011 |

OTHER PUBLICATIONS

Machine translation of JP-2010246700-A to Kimura et al. (Year: 2010).*

European Search Report for Counterpart EP20197870.7, dated Dec. 8, 2020.

* cited by examiner

LAUNDRY TREATING APPLIANCE WITH A BELLOWS

BACKGROUND

Laundry treating appliances, such as clothes washers, clothes dryers, combination washer/dryers, refreshers, and non-aqueous systems, can have a configuration based on a rotating drum, located within a tub, which is located within a cabinet. The drum defines a treating chamber having an access opening and the cabinet has a corresponding opening. An annular bellow often extends between the cabinet opening and the tub and/or drum. A closure, such as a door, is typically provided to effectively close the access opening during operation of the appliance. The closure can form a liquid seal with the cabinet and/or the bellow.

During operation of the laundry treating appliances, lint may accumulate on the bellow. When the closure is opened, the accumulated line is visible to the user and is considered aesthetically undesirable to many users, while some user incorrectly associate the accumulated lint with a fault or failure of the appliance, which can lead to an unnecessary service call. Current appliance configurations and methods of operation do not address the accumulation of lint on the bellow.

BRIEF SUMMARY

In one aspect, the present disclosure relates to a laundry treating appliance comprising: a chassis defining an interior with a chassis opening, a tub located within the interior and defining a tub interior having a tub opening, a rotatable drum located within the tub interior and defining a treating chamber with an access opening, an annular bellows extending between the tub opening and the chassis opening and having an inner peripheral surface, a closure selectively moveable relative to the chassis opening to selectively open/close the chassis opening, an air recirculating assembly having a blower fluidly coupled to a recirculation conduit with an inlet and an outlet fluidly coupled to the treating chamber; and, at least one deflector fluidly coupled to the outlet and oriented to deflect, at least a portion of the air emitted through the outlet, in a circumferential direction about the inner peripheral surface.

DETAILED DESCRIPTION

Aspects of the present disclosure relate to an annular bellows of a laundry treating appliance. The annular bellows may produce an axial, or radial drying airflow in the laundry treating appliance. The annular bellows may further include a deflection component to create a circumferential airflow in the laundry treating appliance. The annular bellows can be used in any type of laundry treating appliance needing to dry laundry, such laundry treating appliances can be a clothes dryer or a combination washer/dryer (combo).

In traditional combination washing and drying machines, drying air can be delivered to the tub interior near a bellows in a radial direction. However, this can result in an excess of lint building being built up around a chassis opening of the laundry treating appliance. The present disclosure sets forth a laundry treating appliance having an annular bellows that may direct drying air through a deflection component, which in turn may induce at least a portion of the drying air into a circumferential airflow. This directional airflow has been found to dramatically reduce the accumulation of lint around portions of the chassis opening.

Figure 1:
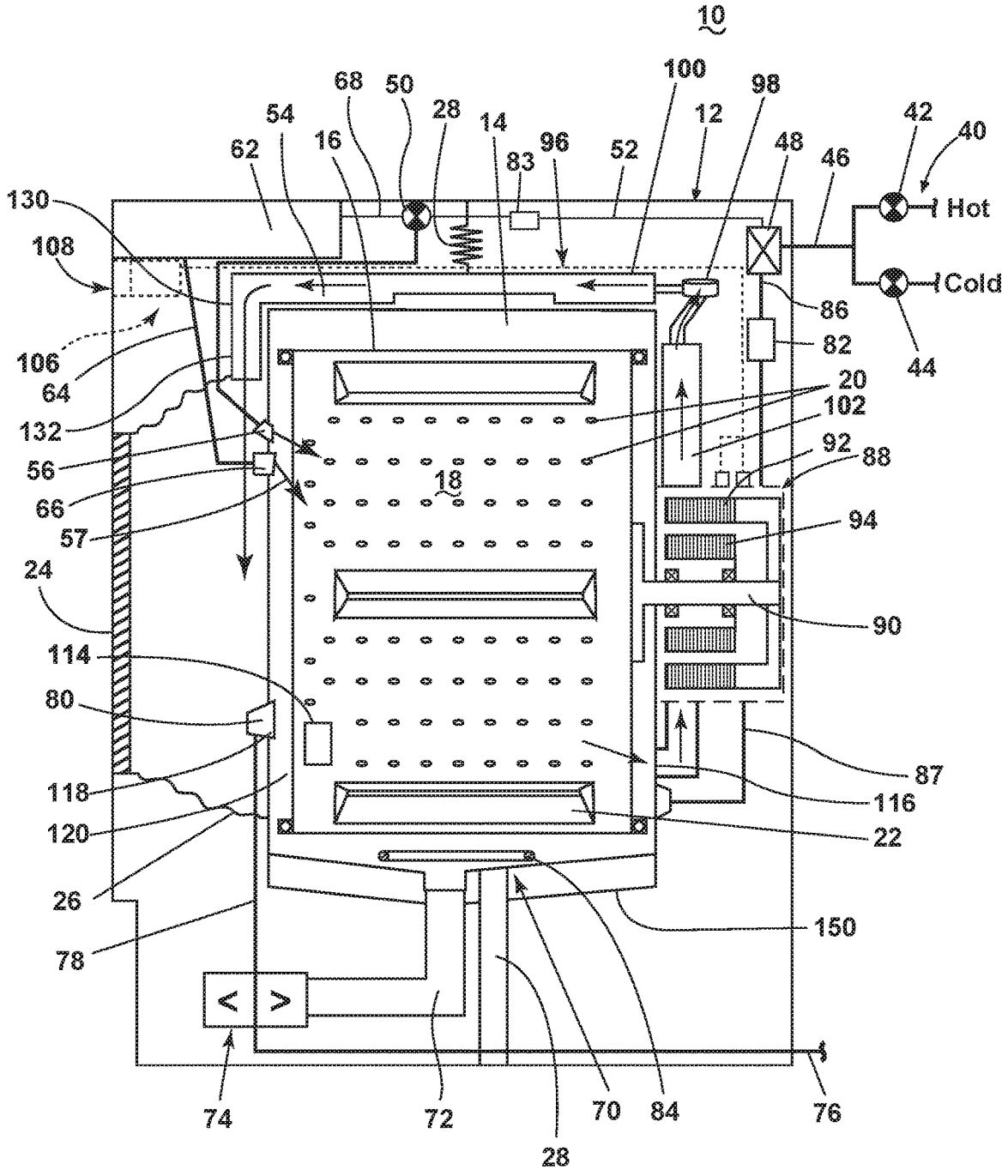
FIG. 1 illustrates a schematic cross-sectional view of a laundry treating appliance in the form of a combination washing and drying machine having an air flow assembly according to an aspect of the present disclosure.

FIG. 1 is a schematic cross-sectional view of a laundry treating appliance according to an aspect of the present disclosure. The laundry treating appliance can be any appliance which performs an automatic cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance is illustrated herein as a horizontal axis, front-load laundry treating appliance, the aspects of the present disclosure can have applicability in laundry treating appliances with other configurations.

Washing machines are typically categorized as either a vertical axis washing machine or a horizontal axis washing machine. The terms vertical axis and horizontal axis are often used as shorthand terms for the manner in which the appliance imparts mechanical energy to the load of laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum can rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The exemplary laundry treating appliance of FIG. 1 is illustrated as a horizontal axis combination washing and drying machine 10, which can include a structural support system comprising a cabinet 12, with a cabinet opening 13, and which defines a housing within which a laundry holding system resides. While illustrated as a combination washing and drying machine 10 it should be understood that the method as described herein can be implemented in a stand-alone washing machine or a stand-alone dryer. The cabinet 12 can be a housing having a chassis and/or a frame, to which decorative panels can or cannot be mounted, defining an interior enclosing component typically found in a conventional washing machine, such as motors, pumps, fluid lines, controls, sensors, transducers, and the like. Such components will not be described further herein except as necessary for a complete understanding of the present disclosure.

The laundry holding system comprises a tub 14, with a tub opening 15, dynamically suspended within the structural support system of the cabinet 12 by a suitable suspension system 28 and a drum 16, with a drum opening 17, provided within the tub 14, the drum 16 defining at least a portion of a treating chamber 18. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. It is also within the scope of the present disclosure for the laundry holding system to comprise only one receptacle with the receptacle defining the laundry treating chamber for receiving the load to be treated. At least one lifter 22 can extend from a wall of the drum 16 to lift the laundry load received in the treating chamber 18 while the drum 16 rotates.

The laundry holding system can further include a closure 24 which can be movably mounted to the cabinet 12 to selectively close the cabinet opening 13, which is aligned with the tub and drum openings 15 and 17. An annular bellows 26 can extend between the cabinet opening 13 and the tub opening 15 or, alternatively, the drum opening 17. The bellows includes an inner peripheral surface 27. The closure 24 sealing against the annular bellows 26 when the closure 24 closes the cabinet opening 13. The closure 24 may be any known closure device such as, but not limited to, a door, a hatch, a drawer, or the like.

The combination washing and drying machine 10 can further comprise a washing circuit which can include a liquid supply system for supplying water to the combination washing and drying machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 or the drum 16 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid 58 into the tub 14. In this manner, water from the household water supply 40 can be supplied directly to the tub 14. While the valves 42, 44 and the inlet conduit 46 are illustrated exteriorly of the cabinet 12, it will be understood that these components can be internal to the cabinet 12.

The combination washing and drying machine 10 can also be provided with a dispensing system for dispensing treating chemistry to the treating chamber 18 for use in treating the load of laundry according to a cycle of operation. The dispensing system can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The combination washing and drying machine 10 can also include a recirculation and drain system for recirculating liquid within the laundry holding system and draining liquid from the combination washing and drying machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the combination washing and drying machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the load of laundry within.

The liquid supply and/or recirculation and drain system can be provided with a heating system which can include one or more devices for heating laundry and/or liquid supplied to the tub 14, such as a steam generator 82, an inline heater 83 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition, or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the combination washing and drying machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The combination washing and drying machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The motor 88 can rotate the drum 16 at various speeds in opposite rotational directions. In particular, the motor 88 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the at least one lifter 22. Typically, the force applied to the fabric items at the tumbling speeds is less than about 1 G. Alternatively, the motor 88 can rotate the drum 16 at spin speeds wherein the fabric items rotate with the drum 16 without falling. The spin speeds can also be referred to as satellizing speeds or sticking speeds. Typically, the force applied to the fabric items at the spin speeds is greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The combination washing and drying machine 10 can further include a recirculation system 96 that can be a closed loop or an open loop circuit. A closed loop system is illustrated where the recirculation system 96 can include a blower 98, a condenser 100, and a heating element 102. The condenser 100 can be provided with a condenser drain conduit (not shown) that fluidly couples the condenser 100 with the pump 74 and the drain conduit 76. Condensed liquid collected within the condenser 102 can flow through the condenser drain conduit to the pump 74, where it can be provided to the recirculation and drain system. In an exemplary aspect, the recirculation system 96 can be provided adjacent an upper portion of the tub 14, though it will be understood that the recirculation system 96 need not be provided adjacent an upper portion of the tub 14, and can be provided at any suitable location adjacent the tub 14. It is further contemplated that an open loop circuit is implemented where air is heated, passes through the drum 16 and is exhausted out of the combination washing and drying machine 10, in which case a condenser 100 is not necessary.

The recirculation system 96 may supply the drying air 104 to the treating chamber 18 via the perforations 20, or through a recirculation conduit 130 including an inlet 116, and an outlet defined by a deflection component 132 as described herein. At least a portion of the drying air 104 can enter the treating chamber 18 via the recirculation conduit 130 and the chassis opening 118.

The combination washing and drying machine 10 also includes a control system for controlling the operation of the combination washing and drying machine 10 to implement one or more cycles of operation. The control system can include a controller 106 located within the cabinet 12 and a user interface 108 that is operably coupled with the controller 106. The user interface 108 can include one or more knobs, dials, switches, displays, touch screens and the like for communicating with the user, such as to receive input and provide output. The user can enter different types of information including, without limitation, cycle selection and cycle parameters, such as cycle options.

The controller 106 can include the machine controller and any additional controllers provided for controlling any of the components of the washing machine 10. For example, the controller 106 can include the machine controller and a motor controller. Many known types of controllers can be used for the controller 106. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
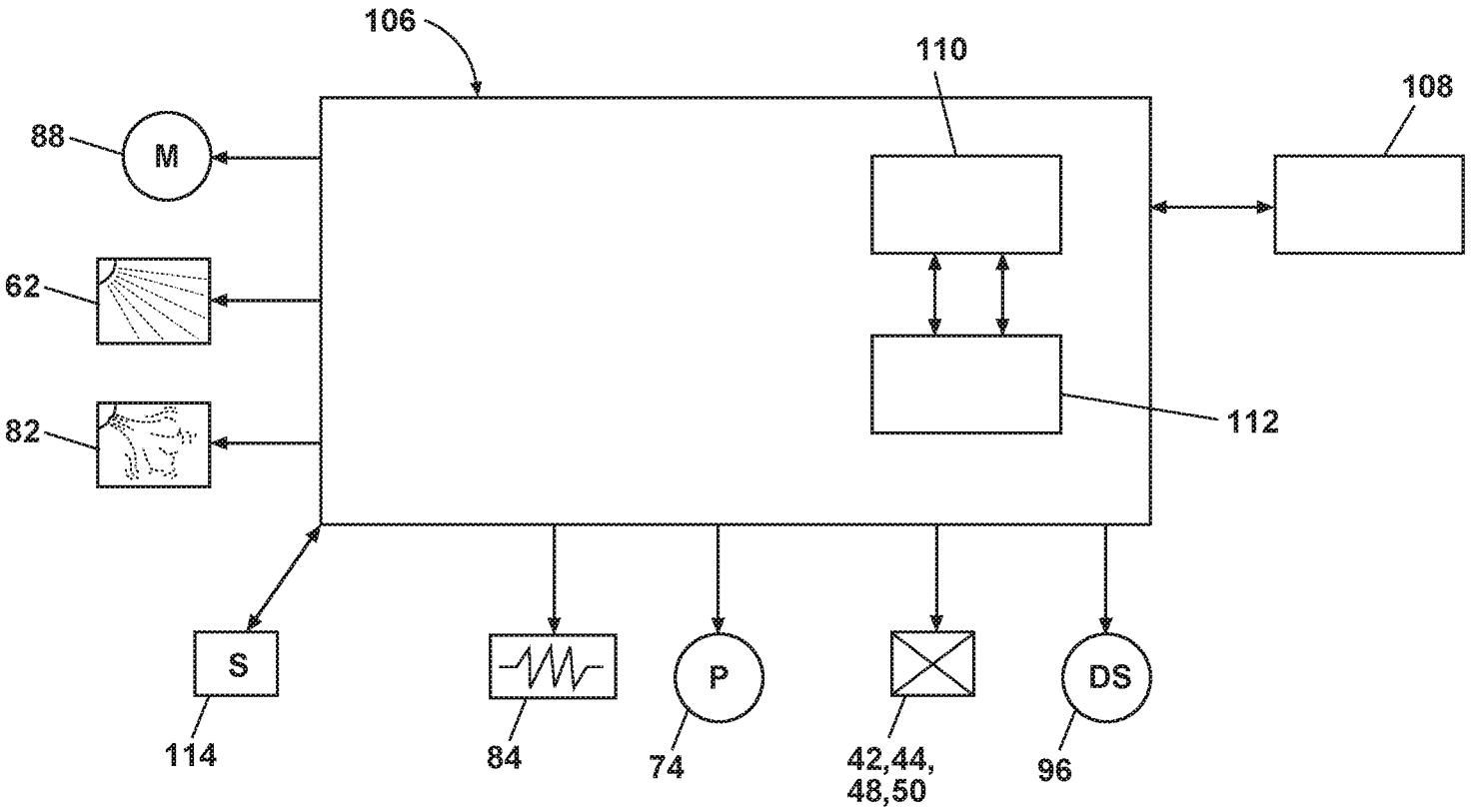
FIG. 2 illustrates a schematic of a control system of the laundry treating appliance of FIG. 1 according to an aspect of the present disclosure.

As illustrated in FIG. 2, the controller 106 can be provided with a memory 110 and a central processing unit (CPU) 112. The memory 110 can be used for storing the control software that is executed by the CPU 112 in completing a cycle of operation using the combination washing and drying machine 10 and any additional software. Examples, without limitation, of cycles of operation include: wash, heavy duty wash, delicate wash, quick wash, pre-wash, refresh, rinse only, and timed wash. The memory 110 can also be used to store information, such as a database or table, and to store data received from one or more components of the combination washing and drying machine 10 that can be communicably coupled with the controller 106. The database or table can be used to store the various operating parameters for the one or more cycles of operation, including factory default values for the operating parameters and any adjustments to them by the control system or by user input.

The controller 106 can be operably coupled with one or more components of the combination washing and drying machine 10 for communicating with and controlling the operation of the component to complete a cycle of operation. For example, the controller 106 can be operably coupled with the motor 88, the pump 74, the treating chemistry dispenser 62, the steam generator 82, the sump heater 84, and the recirculation system 96 to control the operation of these and other components to implement one or more of the cycles of operation.

The controller 106 can also be coupled with one or more sensors 114 provided in one or more of the systems of the washing machine 10 to receive input from the sensors, which are known in the art and illustrated in FIG. 1 in a lower portion of the treating chamber 18 for exemplary purposes only. Non-limiting examples of sensors 114 that can be communicably coupled with the controller 106 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
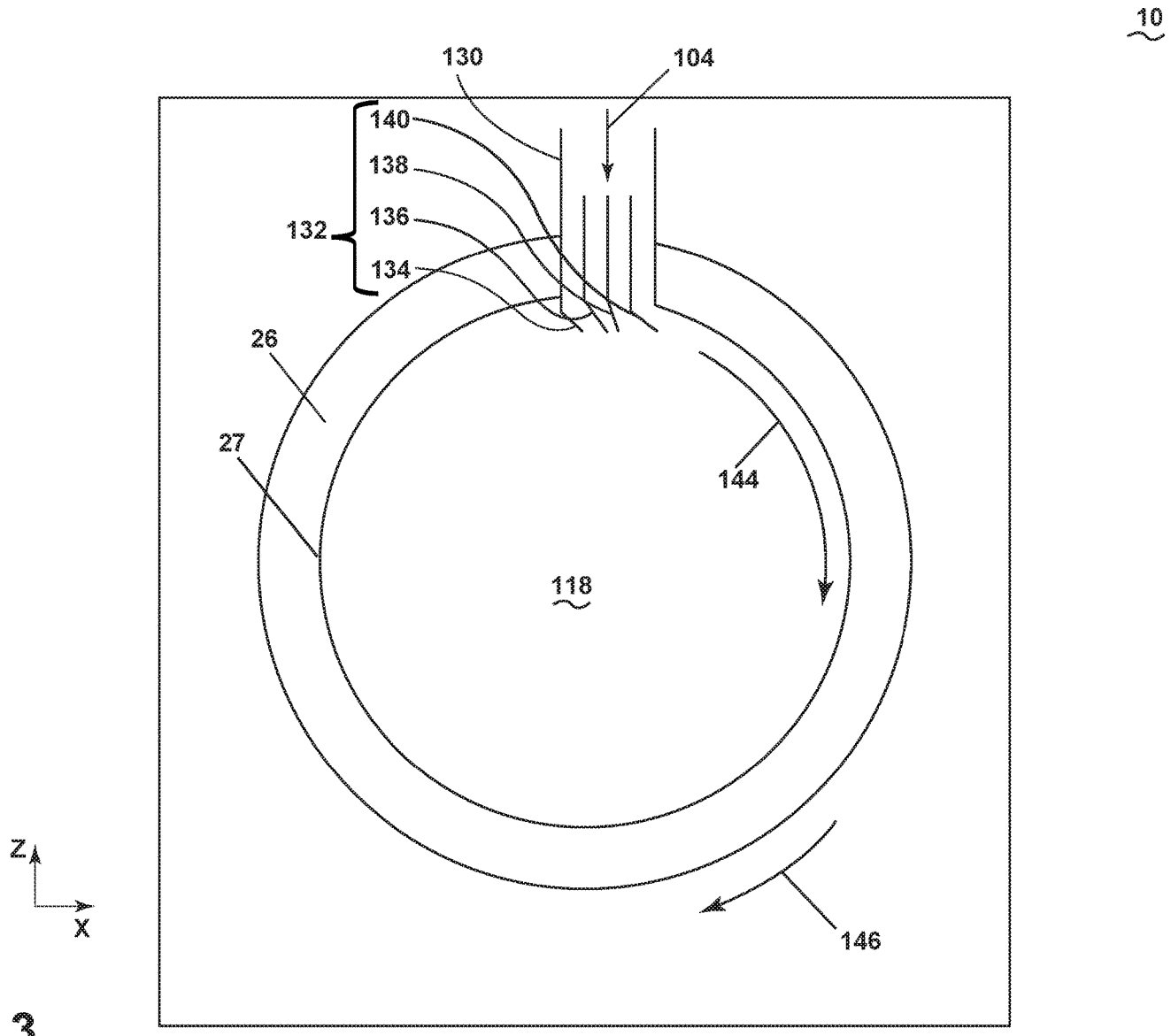
FIG. 3 is a schematic view of a deflection component formed as the outlet of the recirculation conduit of FIG. 1 further including deflectors.

FIG. 3 is a schematic view of the portion of the recirculation conduit 130, which is optionally shown extending through the annular bellows 26 and adapted to channel drying air 104 onto the inner peripheral surface 27 of the bellows 26. A deflection component 132 is fluidly coupled to the recirculation conduit 130. As illustrated, the deflection component 132 is located at a terminal end of the recirculation conduit 130 and extends through the bellows 26. The deflection component 132 may be located in an upper half of the annular bellows 26, or at any other location around the annular bellows 26. The deflection component 132 also does not have to extend through the bellows 26. For example, the deflection component 132 can be located on a branch of the conduit 130, which doesn't pass through the bellows 26.

As illustrated, the deflection component 132 may include multiple deflectors such as first, second, third and fourth deflectors 134, 136, 138, and 140. Any desired number of deflectors can be used. The drying air 104 may be channeled through the recirculation conduit 130 and to the deflection component 132 where it may be separated and channeled to respective deflectors 134-140. The deflectors 134-138 may be in the form of a louver. Alternatively, the deflectors may have any geometry as described herein, or take on other geometries such as being a cylinder, a rib, a ramp, a hook, or the like.

The deflectors 132-140 may be integrally formed as part of the conduit 130, with some of the deflectors 132-140 extending from different walls or surfaces of the conduit 130. The deflectors 132-140 may be formed such that at least a portion of the deflectors 136-140 extends into the recirculation conduit 130 to function as air flow dividers. It will be appreciated that each of the deflectors 136-140 may be removed, moved, or replaced.

Figure 4:
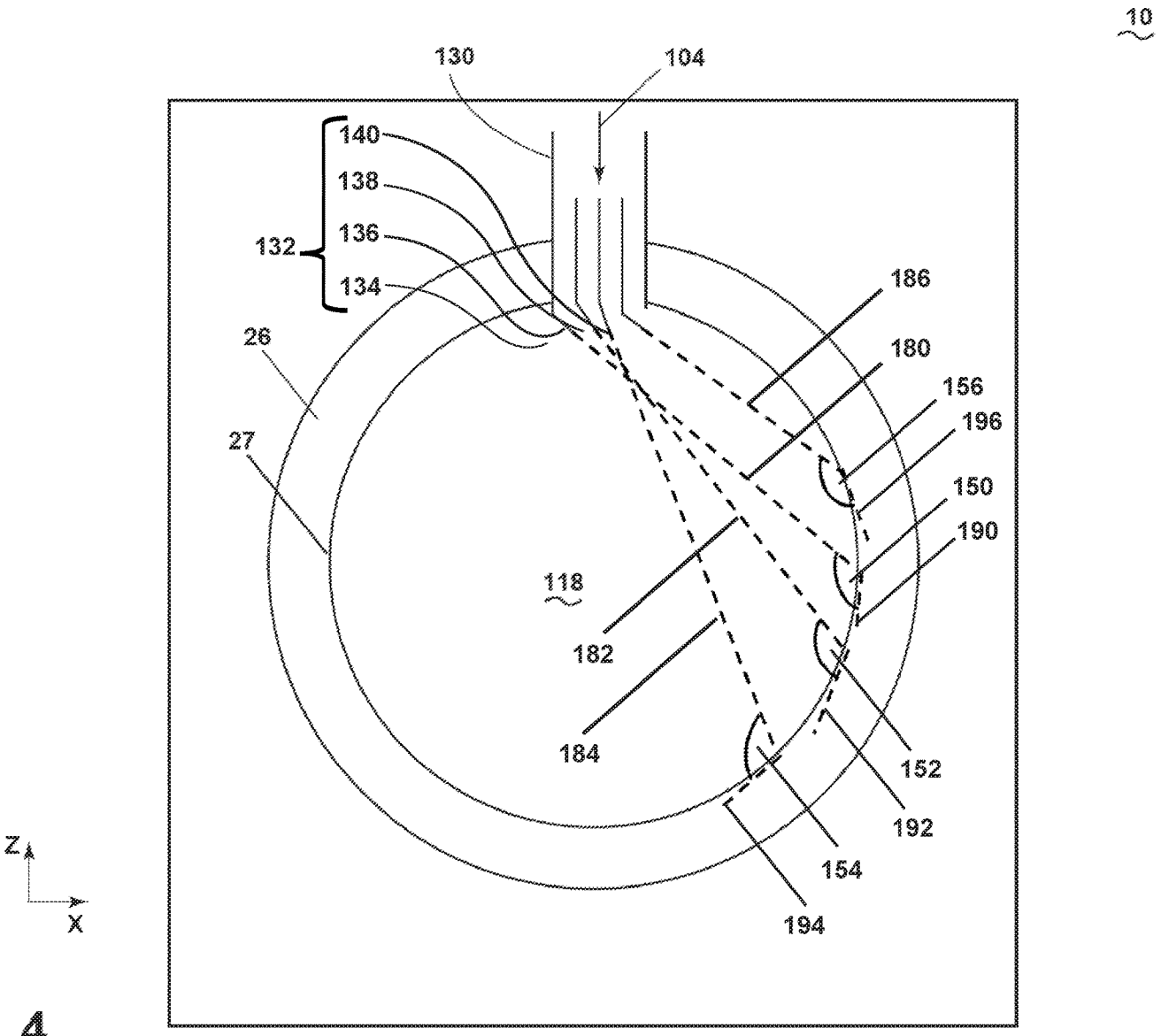
FIG. 4 is an enhanced view of the exemplary deflection component of FIG. 3.

Referring to FIG. 4, the deflectors 134-140 may be angled relative to the drying air 104 of the air passing through the conduit 130. Similarly, it can be thought of that the deflectors 134-140 can be angled relative to the inner peripheral surface 27 of the bellow 26. The angle of the deflectors 134-140 can be quantified by an obtuse angle 150-156 formed between the intersection of a projection 180-186 of the deflector 134-140 with a local tangent line 190-196 to the inner peripheral surface 27 at the point of intersection. By controlling the angle of the deflectors 132-140, the air flow emitted from the deflectors 134-140 can be directed onto the inner peripheral surfaced 27 in a direction that encourages the air to flow around the circumference of the inner peripheral surface without a stagnation point. Such circumferential flow 144 can be quantified by an obtuse angle 150-156 of greater than or equal to 130-160 degrees. The circumferential airflow 144 from the deflectors 134-140 will tend to follow the inner peripheral surface 27 around the chassis opening 118. As the air flow exit path is through the rear wall of the drum 16 and then into the inlet 116 in the tub 14, the air flow will ultimately be drawn away from the inner peripheral surface 27, through the drum 18, and into the inlet 116. The flow from the deflectors 134-140 then forms almost a swirl type flow as it flows along the inner peripheral surface 27 and then through the drum 18. The swirl type flow will be enhanced if the direction of the circumferential flow 144 is in the same direction as the rotational direction of the drum. It is contemplated that the circumferential flow and the drum rotation directions are the same, but that is not necessary.

One or more of the obtuse angles 150-156 can vary from each other such that each projection 180-186 of the deflectors 134-140 can intersect the local tangent lines 190-196 at different obtuse angels 150-156. Alternatively, one or more of the obtuse angles 150-156 can be equal to another one or more of the obtuse angles 150-156.

Figure 5:
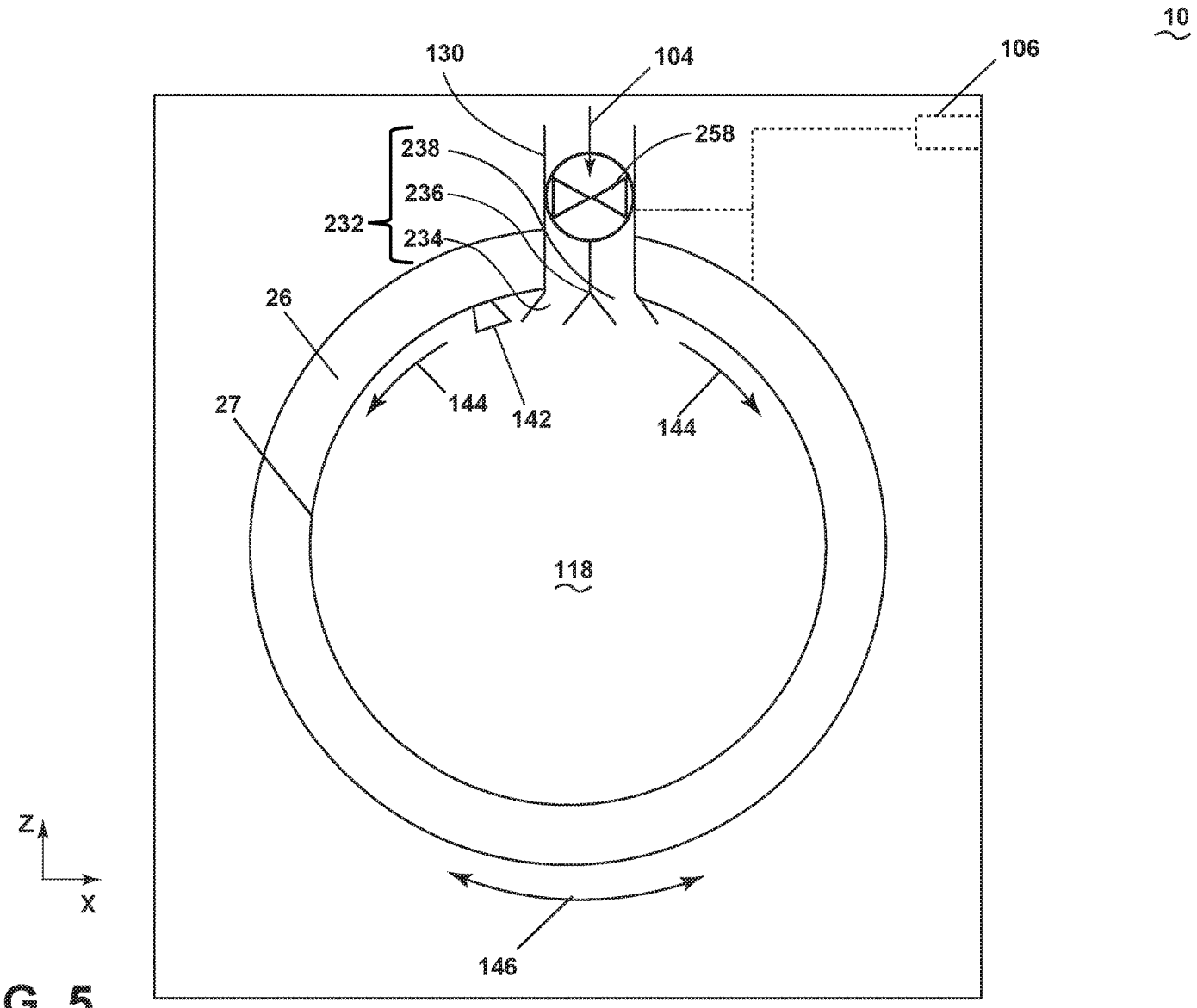
FIG. 5 is a schematic view of an exemplary deflection component formed as the outlet of the recirculation conduit of FIG. 1 further including a switching valve.

FIG. 5 is a schematic view of an exemplary deflection component 232 formed as the outlet of the recirculation conduit 130 of FIG. 1, which may further include a switching valve 258. The switching valve 258 may be any suitable mechanism including, but not limited to, a solenoid, a multi-position multi-port valve, a manual valve, or an electro-magnetic valve. The switching valve 258 may be controlled by the controller 106 to selectively alternate between directing the drying air 104 towards a first deflector 234, or a second deflector 238. The first deflector 234, and the second deflector 238 may be separated via a bi-directional deflector 236 adapted to deflect the circumferential airflow 144 in opposite circumferential directions. This implementation of the bi-directional deflector 236 may allow for the deflection component 232 to deflect the drying air 104 in opposite circumferential directions 144 defined to be counterclockwise or clockwise.

During operation of the combination washing and drying machine 10, the controller 106 may selectively rotate the drum 16 in either the rotational direction 146 defined to be clockwise, or the rotational direction 146 defined to be counterclockwise. Further the controller 106 may actuate the switching valve 258 to create either the circumferential airflow 144 in the clockwise direction, or a circumferential airflow 144 in the counterclockwise direction. The rotational direction 146 of the drum 16 may coincide with the direction of the circumferential airflow 144 along the inner peripheral surface 27. For example, the drum 16 may rotate in the rotational direction 146 defined to be being clockwise, and the controller 106 may activate the switching valve 258 to direct the drying air 104 toward the second defector 238, and around to the inner peripheral surface 27 with the circumferential airflow 144 defined to be clockwise. It will be appreciated that when the drum 16 rotates in the rotational direction 146 defined to be counterclockwise, the switching valve 258 may direct the drying air 104 toward the first deflector 234 and direct drying air 104 along the inner peripheral surface 27 with the circumferential airflow 144 defined to be counterclockwise. Alternatively, the direction of the circumferential airflow 144, along the inner peripheral surface 27 may be different that the direction of the rotational direction 146.

The use of the switching valve 258 may be forgone completely such that the drying air 104 is blown in both counterclockwise and clockwise circumferential directions 144 along the inner peripheral surface 27 regardless of the direction of the rotation 146 of the drum 16.

The implementation of the deflection component 232, and the switching valve 258 may be adapted for use with at least one laundry component 142. The laundry component 142 can be defined as any device of the combination washing and drying machine 10 extending through, or from the annular bellows 26 that may intersect the circumferential airflow 144. For example, the laundry component 142 may be a water sprayer, a steam outlet, a sensor, a latch, or the like. The laundry component 142 may be connected to any one or more of the conduits 64, 68, 78. During operation of the combination washing and drying machine 10 it may be needed that the laundry component 142 be used. This may require that the circumferential airflow 144 does not flow over the laundry component 142 during use of the laundry component 142. The controller 106 may recognize this need for the use of the laundry component 142, and in response actuate the switching valve 258 to direct the drying airflow 104 in a circumferential airflow 144 that does not intersect the laundry component 142, or switch the rotational direction 146 of the drum 16.

Figure 6:
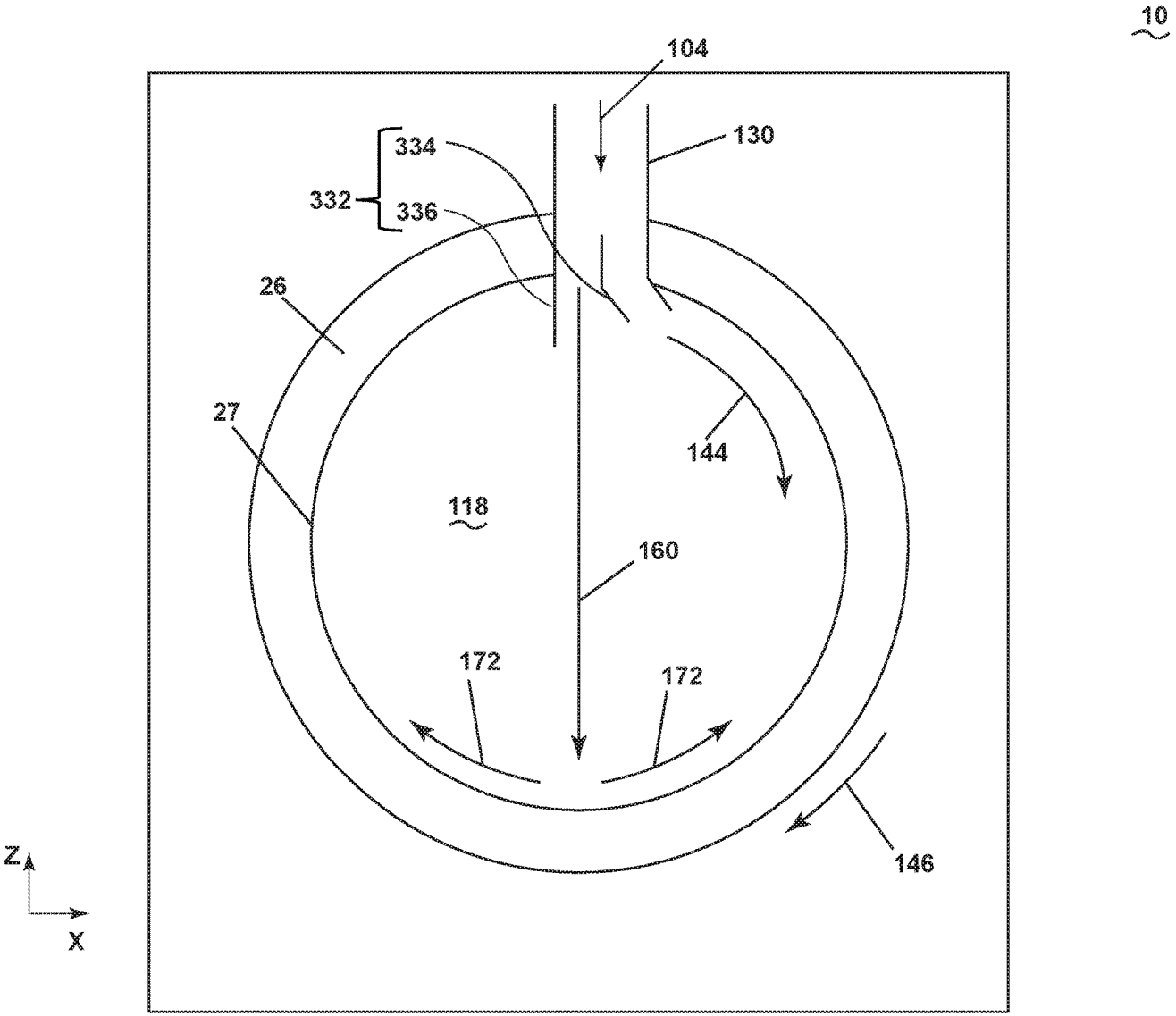
FIG. 6 is a schematic view of an exemplary deflection component formed as the outlet of the recirculation conduit of FIG. 1 further including a vertical deflector.

FIG. 6 is a schematic view of an exemplary deflection component 332 formed as the outlet of the recirculation conduit 130 of FIG. 1, that may create the circumferential airflow 144 described herein, and a transverse airflow 160. The deflection component 332 may include a first deflector adapted to channel the drying air 104 along an inner peripheral surface 27 of the annular bellows 26 in the circumferential direction, and a vertical deflector 336 that may create the transverse airflow 160. The transverse airflow 160 may be defined by a portion of the drying air 104 from the recirculation conduit 130 that is directed to as to extend across the chassis opening 118 and impinge a portion of the inner peripheral surface 27 at the circumferentially distal end of the annular bellows 26 with respect to the deflection component 332. The transverse airflow 160 may then deflect off of the inner peripheral surface 27 defined by a deflection airflow 172. The deflection airflow 172 may be different than from any of the circumferential airflows 144 outlined herein.

Figure 7:
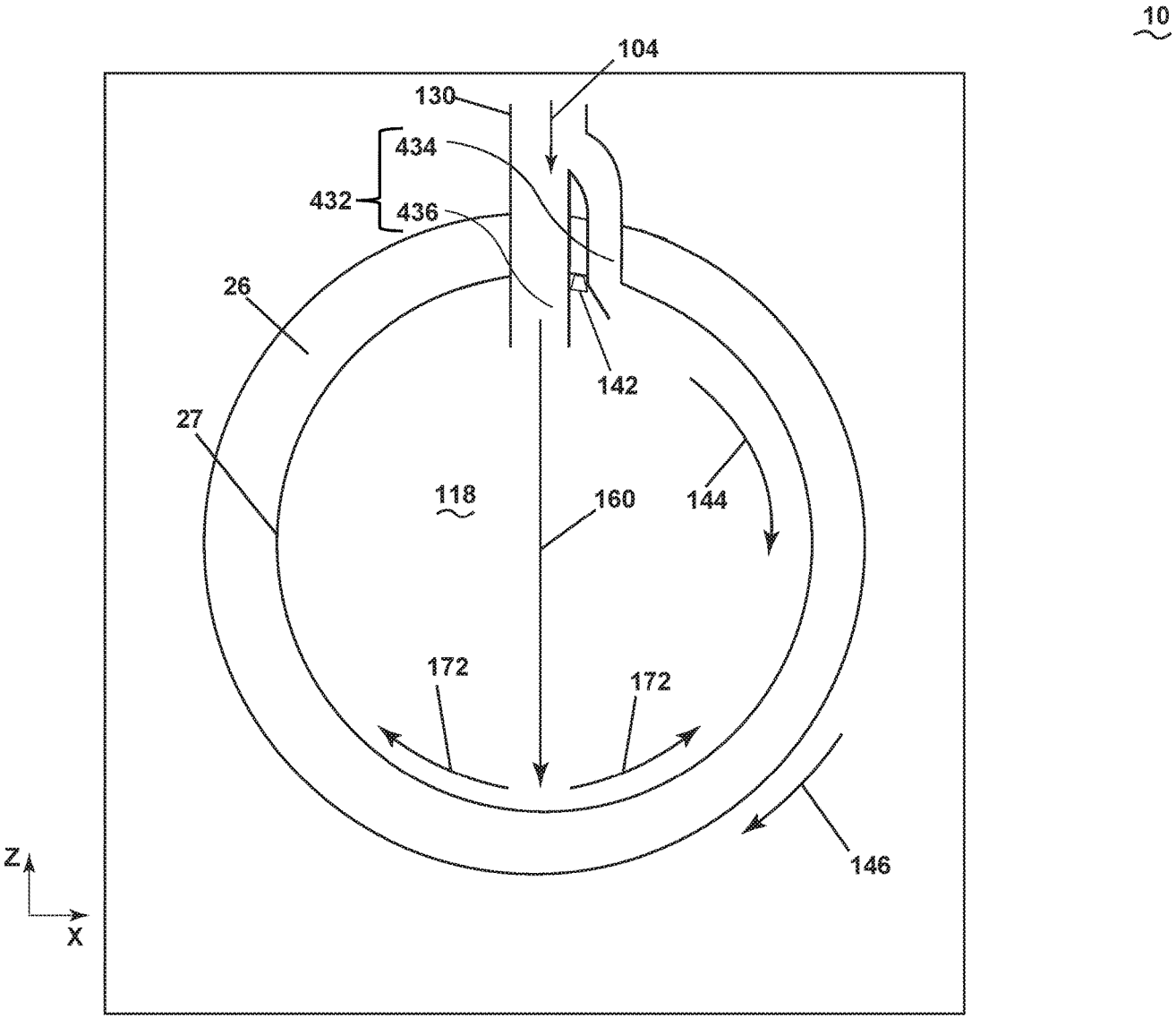
FIG. 7 is a schematic view of an exemplary deflection component formed as the outlet of the recirculation conduit of FIG. 1 further including a bypass deflector.

FIG. 7 is a schematic view of an exemplary deflection component 432 formed as the outlet of the recirculation conduit 130 of FIG. 1. The deflection component 432 may include a vertical deflector 436 adapted to create the transverse airflow 160, and the deflection airflow 172, along with a bypass deflector 434. The bypass deflector 434 may be formed separate therefrom the vertical deflector 436. The bypass deflector 434 may diverge from an exterior wall of the recirculation conduit 130, and extend through the inner peripheral surface 27 of the annular bellows 26. The bypass deflector 434 may channel the drying air 104 around the inner peripheral surface 27 at the circumferential airflow 144.

The deflection component 432 that may include the bypass deflector 434 may be used in instances where the laundry component 142 is included in the combination washing and drying machine 10. The bypass deflector 434 may be formed such that it may go around the laundry component 142. In this instance, the laundry component 142 may be positioned between the vertical deflector 436 and the bypass deflector 434.

Figure 8:
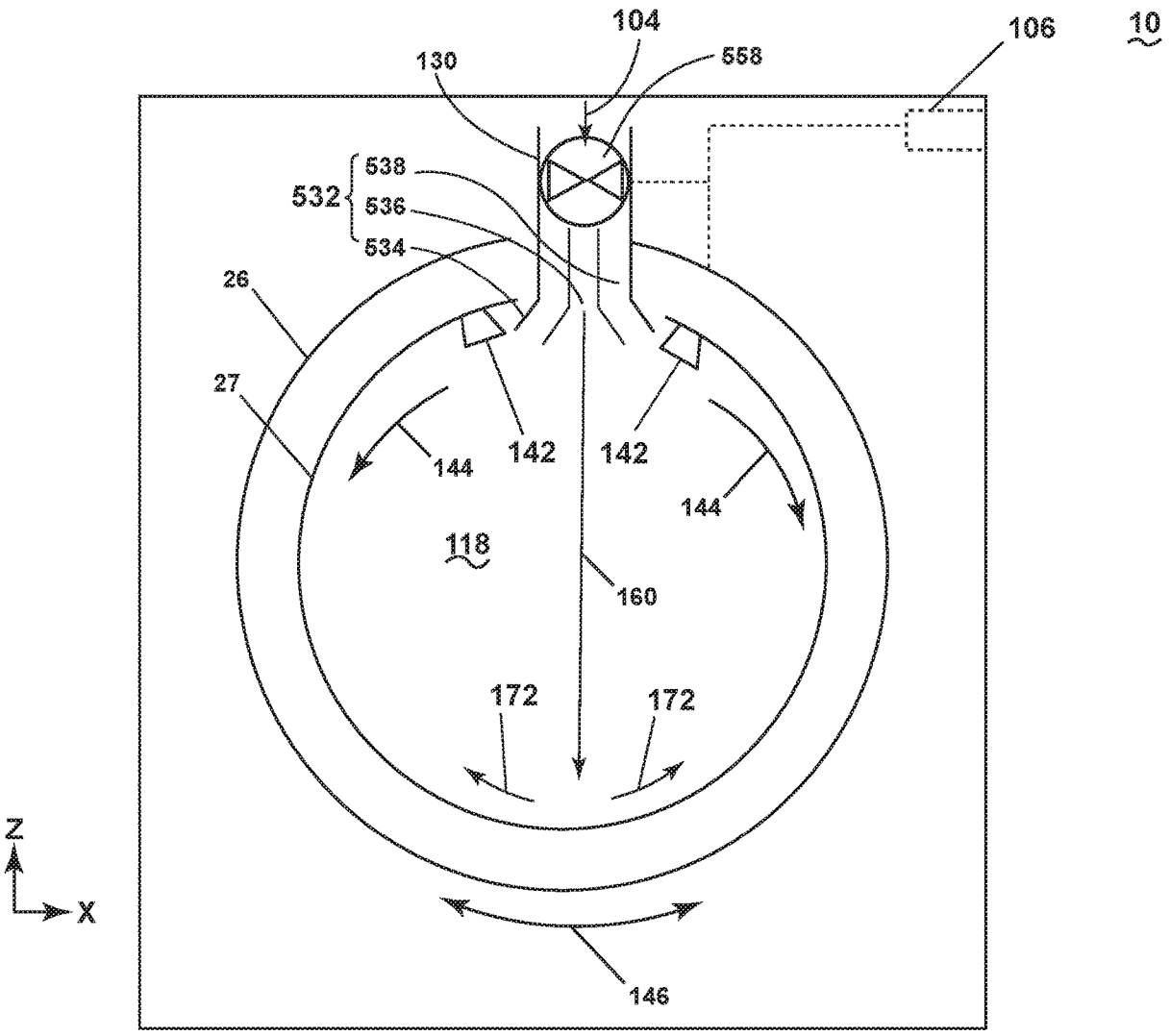
FIG. 8 is a schematic view of an exemplary deflection component formed as the outlet of the recirculation conduit of FIG. 1 further including deflectors, vertical deflector, and a switching valve.

FIG. 8 is a schematic view of an exemplary deflection component 532 formed as the outlet of the recirculation conduit 130 of FIG. 1. The deflection component may include a first deflector 534, a second deflector 538, a vertical deflector 536 and a switching valve 558. The first deflector 534 may direct the drying air 104 along the inner peripheral surface 27 as the circumferential airflow 144 defined to be in the clockwise direction. The second deflector 538 may direct the drying air 104 along the inner peripheral surface 27 as the circumferential airflow 144 defined to be in the counterclockwise direction. The vertical deflector 536 may direct the drying air 104 toward the circumferentially distal end of the annular bellows 26 with respect to the deflection component 532, and diverge from the inner peripheral surface 27 as the deflection airflow 172.

The switching valve 558 may selectively supply drying air 104 to one or more of the first deflector 534, the second deflector 538, or the vertical deflector 536 based on the point of time of the laundry cycle, or the activation or deactivation of the laundry components 142.

Figure 9:
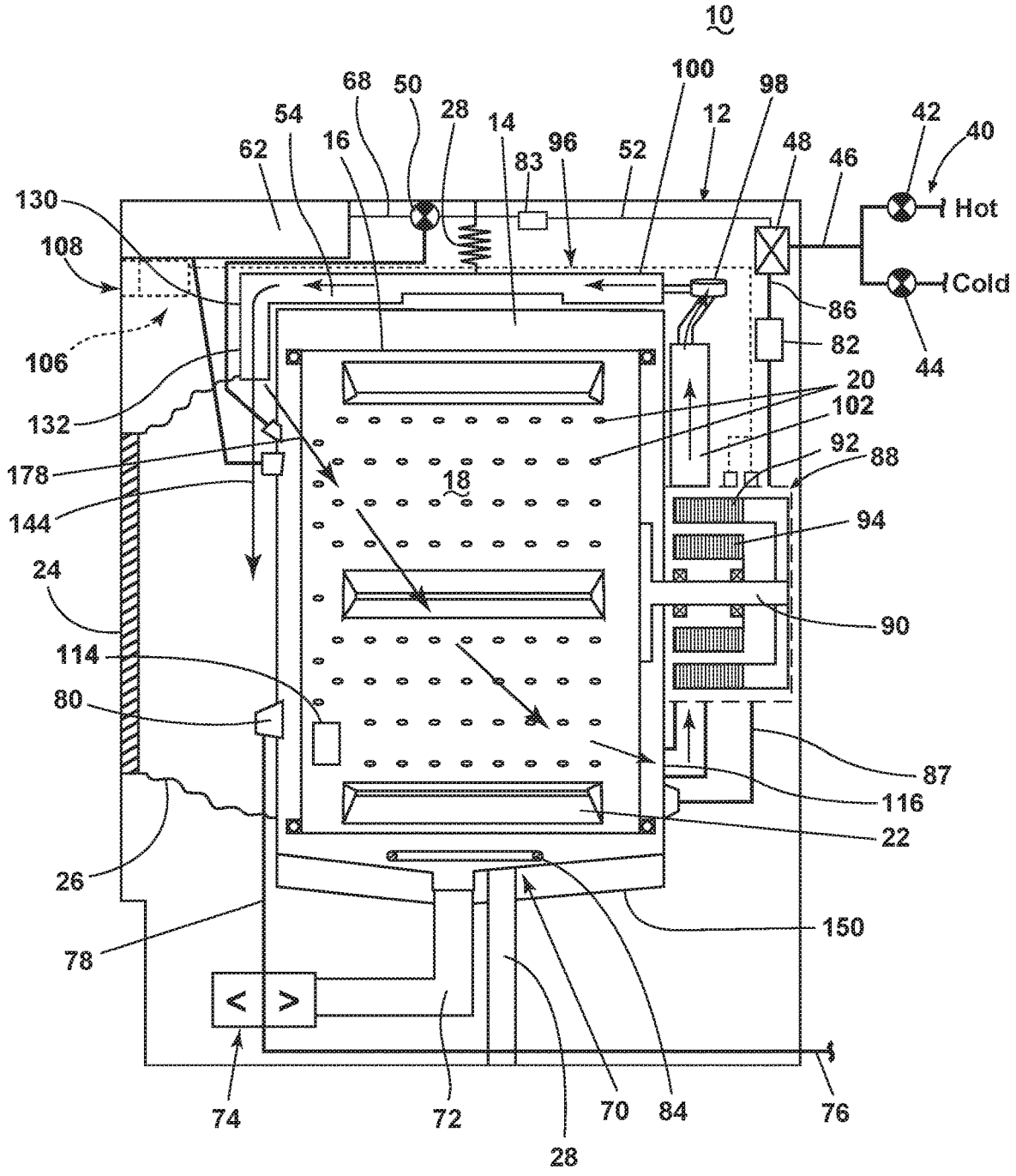
FIG. 9 is a schematic view of an exemplary recirculating airflow of the laundry treating appliance of FIG. 1.

FIG. 9 is a schematic view of the combination washing and drying machine 10 of FIG. 1 including the recirculation conduit 130, and the deflection component 132 further illustrating the circumferential airflow 144 and a recirculating airflow 178. During a drying cycle of the combination washing and drying machine 10, the drying air 104 from the treating chamber 18 may enter the recirculation system 96 through the inlet 116. The drying air may ultimately go through the recirculating conduit and out the deflection component 132 as a circumferential airflow 144. The deflection component 132, however, may additionally divert at least a portion of the drying air 104 as a recirculating airflow 178 defined by an airflow that is diverted directly into the treating chamber 18 through the tub opening 120 and away from the annular bellows 26. The recirculating airflow 178 may be created by including a recirculating deflector (not shown) defined to point into the treating chamber 18 through the tub opening 120 rather than at, or along the inner peripheral surface 27 of the annular bellows 26.

It will be appreciated that the deflection component 132 may further include, or be replaced by, deflection component 232-532, or any combination thereof. It will be further appreciated that the transverse airflow 160 may be present. In this case, the transverse airflow 160 may include the deflection airflow 172 where at least a portion of the deflection airflow may enter the treating chamber 18 directly. Many variations exist.

To the extent not already described, the different features and structures of the various aspects can be used in combination with others as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

The combination washing and drying machine 10 that may include recirculation conduit 130, and any deflection component 132-532, or any combination thereof, may benefit over conventional laundry treating appliances for various reasons descried herein.

The deflection component 132-532 may include deflectors described herein that can be angled such that that multiple streams of air can be emitted toward the inner peripheral surface 27 at different angular orientations. In this respect, one or more streams emitted in generally the same circumferential direction which may be used to create the circumferential airflow 144. It may be beneficial to have these streams of air emitted at different angular orientations as it may enhance the effect of the circumferential airflow 144, and its capability to properly travel a portion of annular bellows 26 against the inner peripheral surface 27. Alternatively, the angular orientation of one or more of the angled deflectors may be the same angular orientation.

The circumferential airflow 144 may travel to the circumferentially distal end of the of the annular bellows 26 with respect to the deflection component 132-532, and then diverge from the inner peripheral surface 27 and into the tub opening 120. Alternatively, the circumferential airflow 144 may extend around the entire inner peripheral surface 27 the annular bellows 26 before it diverges through the tub opening 120. Any portion of the circumferential airflow 144 may go travel any distance along the inner peripheral surface 27. For example, portions of the circumferential airflow 144 may diverge from the inner peripheral surface 27 at a rate such that as the circumferential airflow 144 follows the inner peripheral surface 27, the circumferential airflow 144 may dissipate with portions diverging into the tub opening 120 along the entire travel distance along the inner peripheral surface until all of the circumferential airflow 144 has diverged from the inner peripheral surfaced 27 and through the tub opening 120.

The use of the recirculation conduit 130 and the deflection component 132-532 as described herein may be used during the drying phase of the combination washing and drying machine 10. The deflection component 132-532 may create the circumferential airflow 144. The circumferential airflow 144 may be used to retard lint collection on the inner peripheral surface 27 of the annular bellows 26 by physically blowing away the accumulated lint. Additionally, the circumferential airflow 144 may ensure that the inner peripheral surface 27 of the annular bellows 26 is sufficiently dry such that lint will not stick, or clump to the inner peripheral surface 27 as it would if the inner peripheral surface 27 was wet.

Although shown to be using drying air 104, the recirculation conduit 130 may use a blowing air (not shown). The blowing air may be defined by any air that flows through the recirculation system 96, but is not condensed by the condenser 100, or heated by the heating element 102. The blowing air may have the same characteristics (e.g., moisture, or temperature) at the inlet 116 as the outlet, or the deflection component 132-532 of the recirculation conduit 130. The blowing air and the drying air 104 may come from the same air source defined by the air in the treating chamber 18 which enters the recirculation system 96 through inlet 116. The use of the blowing air, or the drying air 104 may be beneficial in cases where there is a preferred remaining moisture content (RMC) of the articles in the treating chamber 18. For example, if the RMC is measured by the one or more sensors 114 to be at the desired RMC, then the controller 106 may shut off the condenser 100, or heating element 102 and continue to blow blowing air through the recirculation system. This may be done in cases where it is found that lint still remains on the annular bellows 26 even after the preferred RMC has been reached. The blowing air may still be used to remove, or retard the lint accumulation even after the RMC has been reached. Conversely, if the one or more sensors 114 determine that the preferred RMC has not been reached, the controller 106 may determine that the preferred RMC may be reached by turning on the condenser 100, or heating element 102 and circulating the drying air 104 through the recirculation system 96. This will ensure that the drying air 104 passes through the recirculation conduit 130 and out the deflection 132-532 to clear, or retard lint accumulation along the inner peripheral surface 27 of the annular bellows 26 while at the same time heating, or drying the articles in the treating chamber until they are at a preferred RMC value.

The deflection component 132-532 can be used in a pass-through system instead of the recirculation system 96 as illustrated. In this case, the deflection component 132 can be provided as an outlet for a conduit of the pass-through system. In this case, hot air can be blown into the drum 18 via the circumferential airflow 144, or other airflows created form the deflection component 132-532 described herein. From here, instead of recirculating the air through inlet 116 and the recirculation conduit 96, the blown/drying air can exit through an outlet to an exterior of the combination washing and drying machine 10.

The alternation of the rotational direction 146 of the drum 16 may be beneficial during multiple stages of the laundry cycle. For example, in between a final rinse stage, and a drying phase of the combination washing and drying machine 10 it may be beneficial to include a tumbling stage. This stage may be used to obtain the preferred RMC of the articles in the treating chamber 18, or to effectively break up clumps of articles before a drying cycle. The tumbling stage may be best performed by alternating the rotational direction 146 of the drum 16. During the tumbling stage, however, lint may accumulate at the circumferentially distal end of the annular bellows 26 with respect to the deflection component 132. The use of the circumferential airflow 144 and its capability to retard lint collection will be appreciated.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure.

The invention claimed is:

1. A laundry treating appliance comprising:

a chassis defining an interior with a chassis opening;

a tub located within the interior and defining a tub interior having a tub opening;

a rotatable drum located within the tub interior and defining a treating chamber with an access opening;

an annular bellows extending between the tub opening and the chassis opening and having an inner peripheral surface;

a closure selectively moveable relative to the chassis opening to selectively open/close the chassis opening;

an air recirculating assembly having a blower fluidly coupled to a recirculation conduit with an inlet and an outlet fluidly coupled to the treating chamber; and at least one deflector extending through the bellows, fluidly coupled to the outlet, and oriented at an angle relative to the inner peripheral surface to deflect at least a portion of the air emitted through the outlet such that the air flows in a circumferential direction about the inner peripheral surface around the chassis opening.

2. The laundry treating appliance of claim 1 wherein the drum rotates in a first rotational direction that is the same as the circumferential direction.

3. The laundry treating appliance of claim 2 wherein the drum selectively rotates between opposite first and second rotational directions.

4. The laundry treating appliance of claim 3 wherein the selectively rotating of the drum comprises alternating between the first and second rotational directions.

5. The laundry treating appliance of claim 1 wherein the at least one deflector comprises at least first and second deflectors.

6. The laundry treating appliance of claim 5 wherein the first and second deflectors are orientated to deflect air in the same circumferential direction.

7. The laundry treating appliance of claim 5 wherein the first and second deflectors are orientated to deflect air in opposite circumferential directions.

8. The laundry treating appliance of claim 5 wherein the first and second deflectors have the same angular orientation relative to the inner peripheral surface.

9. The laundry treating appliance of claim 5 wherein the first and second deflectors have different angular orientations relative to the inner peripheral surface.

10. The laundry treating appliance of claim 1 wherein the outlet is located in the bellows.

11. The laundry treating appliance of claim 10 wherein the outlet is located in an upper half of the bellows.

12. The laundry treating appliance of claim 1 wherein the deflector comprises a louver fluidly coupled to the outlet.

13. The laundry treating appliance of claim 12 wherein the louver passes through the bellows.

14. The laundry treating appliance of claim 1 wherein the laundry treating appliance is a combination washer/dryer.

* * * * *